United States Patent [19]

Hruda

[11] 4,438,302

[45] Mar. 20, 1984

[54] ELECTRICAL SHORTING SWITCH ASSEMBLY INCLUDING A LAST TO OPEN LAST TO CLOSE ARCING SWITCH

[75] Inventor: Robert M. Hruda, Horseheads, N.Y.

[73] Assignee: Westinghouse Electric Corp., Pittsburgh, Pa.

[21] Appl. No.: 349,484

[22] Filed: Feb. 17, 1982

[51] Int. Cl.[3] ..... H01H 3/00; H01H 33/66

[52] U.S. Cl. ..... 200/17 R; 200/144 B

[58] Field of Search ..... 200/1 B, 17 R, 18, 144 R, 200/144 B, 145, 146 R, 153 V; 361/3, 13

[56] References Cited

U.S. PATENT DOCUMENTS

| | | | |
|---|---|---|---|
| 1,094,690 | 4/1914 | Wood | 200/153 V X |
| 3,174,019 | 3/1965 | Jansson | 200/153 V |
| 3,469,048 | 9/1969 | Lee et al. | 200/146 R |
| 4,000,480 | 12/1976 | Gray et al. | 200/146 R X |
| 4,016,385 | 4/1977 | Golioto | 200/144 B X |
| 4,121,268 | 10/1978 | Hruda et al. | 307/134 X |
| 4,216,359 | 8/1980 | Hruda | 200/144 B |

*Primary Examiner*—J. R. Scott

*Attorney, Agent, or Firm*—W. G. Sutcliff

[57] ABSTRACT

An electrical shorting switch assembly for use with an electrolytic cell includes a plurality of parallel path electrical switches. One of the switches is an arcing switch which is designed to be a last-to-open and last-to-close switch of the assembly. A common rotatable operating shaft is used to actuate opening and closing of the electrical switches. The arc switch has separate linking means between the arc switch and the shaft which permits sequential operation of the arc switch relative to the main current-carrying switch or switches. The arc switch linking means in conjunction with the linking means for the current switches determine that the arc switch is the last to open and last to close.

6 Claims, 8 Drawing Figures

SWITCH OPEN

CONTACTS MEET

SWITCH CLOSED

CONTACTS SEPERATE

ELECTRICAL SHORTING SWITCH ASSEMBLY INCLUDING A LAST TO OPEN LAST TO CLOSE ARCING SWITCH

BACKGROUND OF THE INVENTION

The present invention relates to electrical shorting switch assemblies such as are used as bypass switches for electrolytic cells in a variety of electrochemical processing plants. The shorting switch assembly will typically include a plurality of hermetically sealed electrical switch members which provide electrically parallel current paths to handle the very large bypass current levels which are typically employed in electrolytic cells. Such an electrical shorting switch assembly is seen in detail in U.S. Pat. No. 4,216,359, owned by the assignee of the present invention and the teachings of which are hereby incorporated by reference. The individual electrically parallelled switches which make up the shorting switch detailed in the aforementioned patent are operated off of a common rotatable operating shaft and are more or less simultaneously opened and closed. In some cases an auxiliary arc contact switch had been employed as one of the switches of a shorting switch assembly to absorb the inductive energy of the bypassed or switched circuit. Such an auxiliary arcing switch in order to be effective must open after the other switches have opened and such a sequential switch opening can be provided by a phased cam system, such as seen in U.S. Pat. No. 4,121,268, owned by the assignee of the present invention.

The shorting switch assemblies described above utilize a rotatable shaft to reciprocate a switch opening and closing means, and this means that arc contacts which are the last to open would then be the first to close when the shorting switch is actuated to return the current to the electrolytic cell. This causes the arcing switch contacts to carry very high current loads and can occasionally result in failure of the arcing switch.

It is desirable to provide an electrica shorting switch assembly which utilizes an arcing switch in a parallel path with one or more normal current-carrying switches, with the arc switch being both a last-to-open and last-to-close switch in the assembly.

It is desirable that electrical shorting switches be latched while in the open or closed position to prevent accidental switch actuation. A positive switch actuation force should be required to open or close the shorting switch.

SUMMARY OF THE INVENTION

An improved electrical shorting switch assembly is described in which an operating mechanism is provided for sequentially operating an arcing switch which comprises one of a plurality of electrically parallel switches in the assembly. The arcing switch is determined by the operating means to be last to open and last to close. The sequential operating means comprises a lost motion means coupled between the standard rotatable operating shaft for the switch assembly and the arcing switch.

BREIF DESCRIPTION OF THE DRAWINGS

DESCRIPTION OF THE PREFERRED EMBODIMENTS

Figure 1:
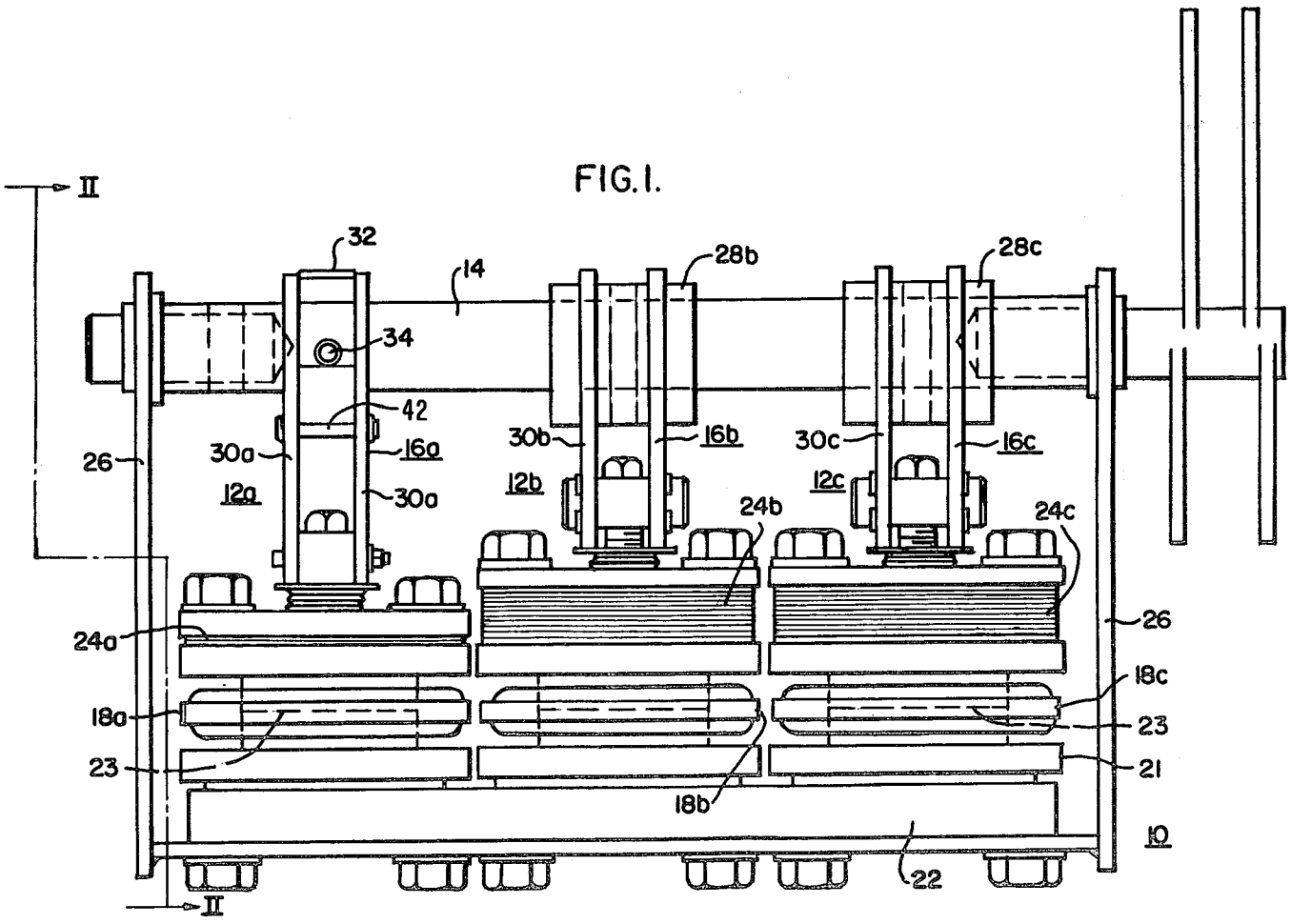
FIG. 1 is a side elevational view of the electrical shorting switch assembly of the present invention including the operating means.

The electrical shorting switch assembly 10 of the present invention is best seen in FIG. 1 wherein three switch modules **12*a*, 12 *b* and 12*c* are connected to a common rotatable operating shaft 14 via respective reciprocal linking means 16*a*, 16*b*, 16*c*. The construction and operation of the main current-carrying switch modules 12*b* and 12*c* and their respective linking means 16*b* and 16*c* and rotatable operating shaft 14 are described in detail in the aforementioned U.S. Pat. No. 4,216,359. The switch modules 12*b* and 12*c* include hermetically sealed electrical switch members 18*b* and 18*c* having flexible diaphragm end portions which permit reciprocal relative motion between the contacts 23 which are shown in phantom in the closed position in FIG. 1. The lower contacts of switches 18*b* and 18*c* are connected via mounting plates 21 to a common bus 22 which extends in a direction out of the drawing and is connectable to one side of the electrolytic cell which is to be bypassed. The upper contacts of switch members 18*b* and 18*c* are connected via flexible buses 24*b*, 24*c* which are connectable to the other terminal of the electrolytic cell. The lower contacts of the switch members 18*b* and 18*c* are held relatively fixed via the common bus 22 and a rigid frame member 26 from which is mounted the operating shaft 14, so that reciprocation of the linking means 16*b* and 16*c*** causes reciprocal motion to make and break contact within the hermetically sealed switches.

The linking means **16*b* and 16*c* which couple the switch members 18*b* and 18*c* to the rotatable operating shaft 14 are described in greater detail in the aforementioned U.S. Pat. No. 4,216,359 with the rotational movement of the shaft 14 converted to a reciprocal force acting on the switch via eccentric cam members 28*b* and 28*c* which are mounted on the shaft and coupled to the elongated links 30*b* and 30*c*. The switch members 18*b* and 18*c*** are approximately simultaneously opened and closed and are the main current-carrying paths during shunting or bypassing of the electrolytic cell with a low DC voltage of less than ten volts across the shorting switch and with a total DC current of tens of thousands of amperes passing through the parallel path switches.

Figure 2:
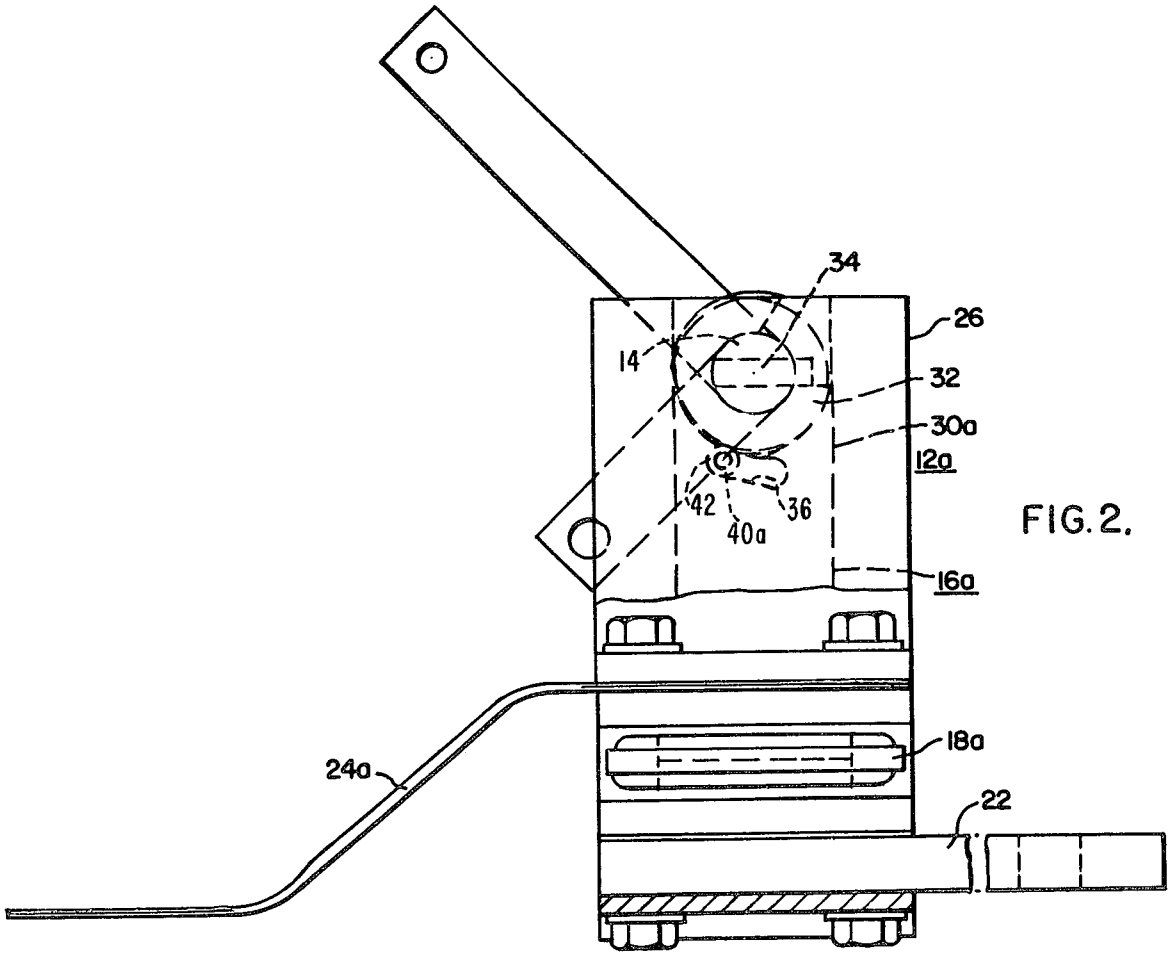
FIG. 2 is an end view taken in the direction of line II of FIG. 1.

The present invention is focused on switch module **12*a* which includes arcing switch member 18*a* and a linking means 16***a* coupling the arcing switch member 18*a* to the common shaft 14. The switch member 18*a* is electrically connected in parallel with switch members 18*b* and 18*c*, with the lower contact connected via mounting pland to the common bus 22. The upper contact of the switch member 18*a* is also connected to a flexible bus 24*a* which is connectable to one terminal of the electrolytic cell commonly connected to the flexible buses 24*b* and 24*c*. It can be seen that the flexible bus 24*a* is much thinner than the flexible buses 24*b* and 24*c*, because the arc switch 18*a* need only carry the bypass current for a short period,. typically less than 50 milliseconds, and because of the sequential operation and contact opening and closing of arc switch member 18*a* relative to the switch members 18*b* and 18*c* as will be explained hereafter. The physical structure of the arcing switch is the same as the current-carrying switch. The electrical contacts within the switch are however formed of conductive metal or alloys which are varied from copper or copper-bismuth high conductivity current-carrying contacts The arc switch module 12*a* is perhaps best seen and understood in FIG. 2, wherein the linking means 16*a* associated with switch module 12*a* can be appreciated in this end view. The linking means 16*a* associated with the arcing module 12*a* is operable to insure that the arc switch is the last-to-open and last-to-close contact in the parallel path shorting switch assembly. The arc contact linking means 16*a* is also seen in various operative positions in FIGS. 3 through 6. The arc contact linking means 16*a* comprises a pair of spaced-apart insulating links 30*a*, 30*aa*, each having elongated apertures 31 provided therethrough to permit the rotatable shaft 14 to pass therethrough. The linking means 16*a* includes a lost motion drive means which is provided via a generally C-shaped ring member 32 which is mounted about shaft 14 between spaced-apart links 30*a*, 30*aa*. A radially extending drive pin 34 extends from the shaft 14 in the gap of the C-shaped member 32 and acts as a stop means and drive means as will be explained hereafter. An inclined cam slot 36 is provided in each of the links 30*a*, 30*aa* notched end notch portions 38*a*, 38*b* with respective cam follower wheels 40*a*, 40*b* fitted in cam slot 36 with a common axle 42 connecting the cam follower wheels, which axle 42 is mounted on the perimeter of the C-shaped member 32.

Figure 3:
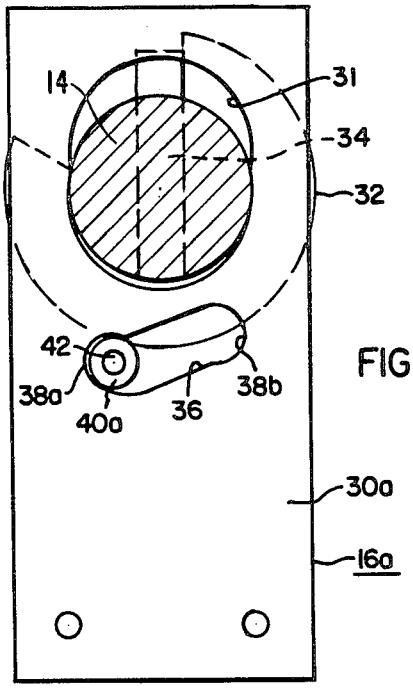
FIG. 3 is an enlarged representation of the reciprocal linking means and lost motion means in the switch open position.
Figure 4:
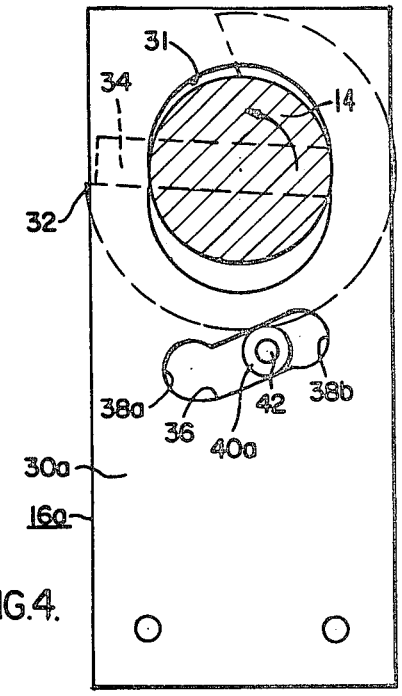
FIG. 4 is an enlarged representation of the reciprocating linking means and lost motion means in the switch position where the arc contacts have first met during a closing operation.
Figure 5:
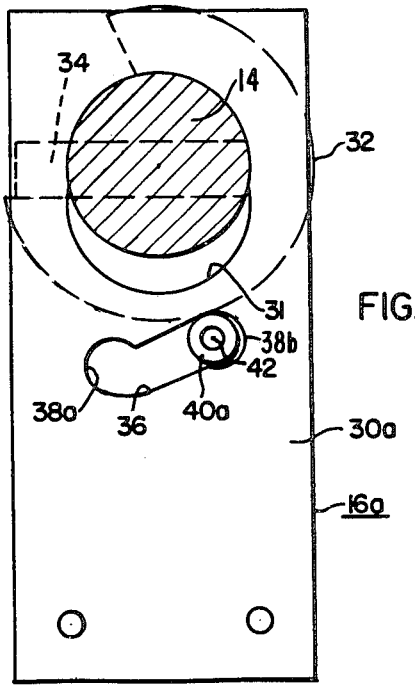
FIG. 5 is an enlarged representation of the reciprocating means and lost motion means in the switch closed position.
Figure 6:
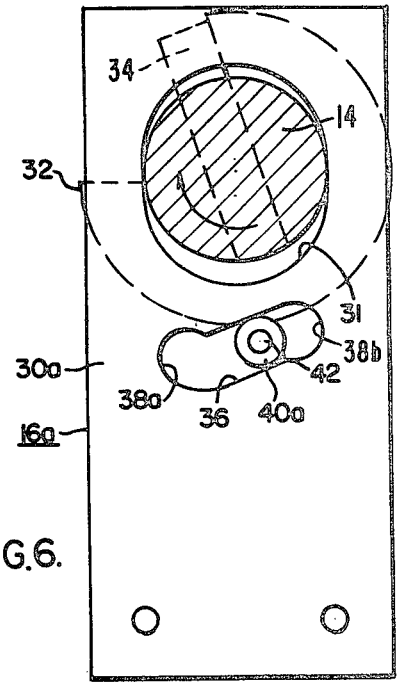
FIG. 6 is an enlarged representation of the reciprocating means and lost motion means in the switch position where the contacts first separate during an opening operation.

The operation of the shorting switch assembly 10 can be appreciated by reference to FIGS. 3 through 6 which illustrate the operation of the lost motion means and the arcing switch module 12*a*. The arcing switch linking means 16*a* is seen in the open switch position in FIG. 3 with the shaft 14 disposed in the lower portion of the elongated openings 31 and the linking means and with drive pin 34 in a generally vertical direction acting as a stop against the C-shaped member 32. The cam follower wheels 40*a* are disposed in the lower notched end 38*a* of the inclined cam slot 36, which notch serves as a latching means which requires sufficient force to move the cam wheels out of the notch before the contact can be moved from either the open position or the closed position. When the arc switch 18*a* is to be closed along with the closing of switch members 18*b* and 18*c*, so that the shorting switch assembly 10 bypasses the electrolytic cell and provides a plurality of parallel current paths through the respective switch members, the operating shaft 14 is rotated as seen in FIG. 4 counterclockwise. The drive pin in moving through the gap area of the C-shaped means 32 provides a lost motion mechanism with the contacts of the arcing switch 18*a* remaining open while the contacts of the main current-carrying switch members 18*b* and 18*c* are closed in this interval. When drive pin 34 is rotated so as to contact the end of the C-shaped member 32 and to force it to rotate again counterclockwise, this forces the axle 42 mounted on the perimeter of the C-shaped member to force the cam wheels out of the end notch in an upward inclined direction along the cam slot 36. The position of the cam wheels as seen in FIG. 4 is generally as the arc contacts of the arc switch 18*a* are meeting. The arc switch member 18*a* is seen in FIG. 5 in the fully closed position wherein the drive pin 34 has been further rotated in a counterclockwise direction so that it is basically horizontal and the cam follower wheels 40*a* have been moved to the upper end of the cam slot 36 and are in upper end notch 38*b*. When the arc contacts of arc switch members 18*a* are to be opened the linking means 16*a* operates in the fashion seen in FIG. 6 wherein the shaft 14 is rotated clockwise, with clockwise movement of the drive pin 34 engaging the other end of the C-shaped member and forcing axle 42 and cam follower wheels out of the upper end notch 38*b* in a downwardly inclined direction in cam slot 36. The linking means 16*a* is seen in FIG. 6 in a position where the contacts have just separated and prior to further rotation in a clockwise direction to the fully open position as seen in FIG. 3.

Figure 7:
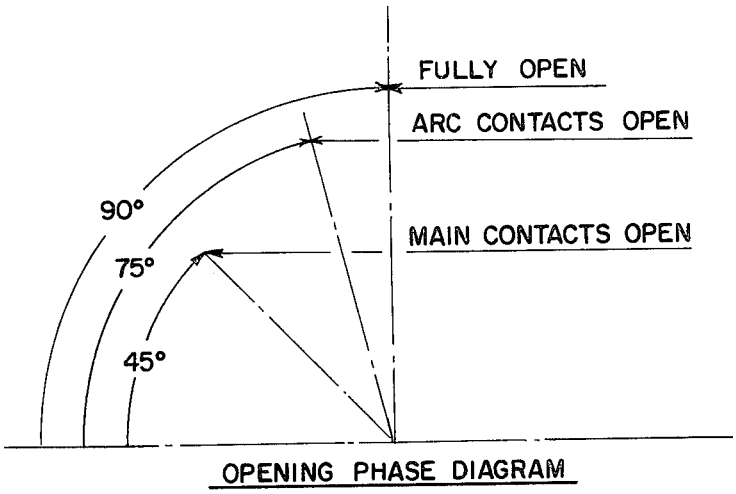
FIG. 7 is a graphical representation illustrating the angular rotation of the operating shaft and lost motion means during an arc switch opening operation.
Figure 8:
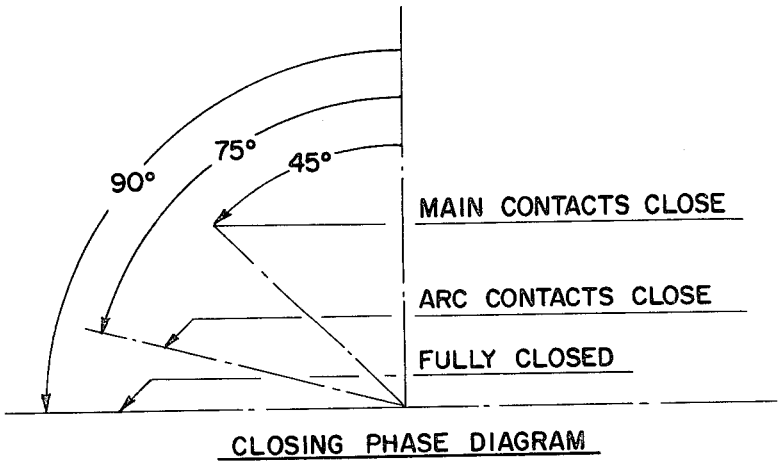
FIG. 8 is a graphical representation illustrating the angular rotation of the operating shaft and lost motion means during an arc switch closing operation.

The operation of the shorting switch assembly 10 can be further appreciated by reference to FIGS. 7 and 8 which are respectively opening phase diagrams and closing phase diagrams, in which the respective timed operation of the switch opening and closing are seen. These Figures further illustrate the last-to-open and last-to-close arcing switch module operation compared to the current carrying switch modules. The opening phase diagram seen in FIG. 7 illustrates when the operating shaft rotates through an angle from the horizontal closed position of 45 degrees, the main current-carrying switch members 18*b* and 18*c* open and a further shaft rotation to the 75 degree position causes the arc contacts of the arc switch member 18*a* to open or separate. The fully opened arc contact position occurs at the 90 degree angular rotation position at which time the cam wheels are locked in the notch for fully opened latched operation. The closing phase diagram of FIG. 8 makes clear that in moving from the vertical open contact position counterclockwise, angular rotation of the shaft through 45 degrees effects closing of the main current-carrying contacts of switch members 18*b* and 18*c*. Further rotation of the shaft through the 75 degree angle position initiates closing of the arc contacts of arc contact member 18*a*, with the fully closed position being reached at the 90 degree angular rotation position or the horizontal position.

I claim:

1. An electrical shorting switch assembly for connection across an electrolytic cell as a bypass shorting switch in parallel with the electrolytic cell comprising:

(a) a plurality of hermetically sealed switch modules which are connected in electrical parallel with respect to each other and to the electrolytic cell, with one of the switch modules comprising an arcing switch module which is the last-to-open and last-to-close switch module;

(b) switch operating means which permits sequential operation of the arcing switch module relative to the other switch modules, including means for determining that the arcing switch module is the last-to-open and last-to-close.

2. The switch assembly set forth in claim 1, wherein a common rotatable operating shaft is coupled to the means for sequentially operating the respective switch modules.

3. The switch assembly set forth in claim 2, wherein the means for sequentially operating the respective switch modules includes a last motion means coupled between the operating shaft and the arcing switch module.

4. The switch assembly set forth in claim 3, wherein the lost motion means comprises a drive pin which is connected to and radially extends from the operating shaft a C-shaped ring member mounted about the operating shaft and rotatable therewith, with the radial drive pin disposed in the gap in the C-shaped ring, and wherein an elongated axle is mounted on the perimeter of the C-shaped ring member, with the end portions of the axle having cam followers rotatably mounted on each end of the axle, a pair of spaced-apart elongated reciprocable members are coupled between the operating shaft and one side of the switch module, which reciprocable members each include an elongated apertured end through which the operating shaft is fitted, and a cam slot is provided in each reciprocable member directed at an angle with respect to the reciprocation direction, with the cam followers fitted in the cam slot, whereby rotation of the operating shaft reciprocally actuates the arcing switch module to open last after current-carrying switch modules are actuated, and also where the arcing switch is closed last after the current-carrying switch modules.

5. The switch assembly set forth in claim 4, wherein a latching notch is provided at each end of the cam slot to provide a latched closed switch condition and a latched open switch condition, with a predetermined force required to be applied to the lost motion means to change these latched conditions by moving the cam followers out of the respective cam slot notches.

6. An electrical shorting switch assembly for connection across an electrolytic cell as a bypass shorting switch in parallel with the electrolytic cell comprising:

(a) a plurality of hermetrically sealed switch modules which are connected in electrical parallel with respect to each other and to the electrolytic cell, with one of the switch modules comprising an arcing switch module which is the last-to-open and last-to-close switch module;

(b) switch operating means which permits sequential operation of the arcing switch module relative to the other switch modules, including means for determining that the arcing switch module is the last-to-open and last-to-close, which switch operating means includes a common rotatable operating shaft connected to the respective switch modules for operation thereof, with a lost motion means coupled between the operating shaft and the arcing switch module to determine that the arcing switch module is the last-to-open and last-to-close.

* * * * *